United States Patent [19]

Baker et al.

[11] Patent Number: 4,936,227

[45] Date of Patent: Jun. 26, 1990

[54] END DOOR FOR RAIL CAR

[75] Inventors: William R. Baker, Lawrenceville, Ga.; James O. Lett, Birmingham, Ala.; James E. Black, Jr., Trenton, Mich.

[73] Assignee: Thrall Car Manufacturing Company, Chicago Heights, Ill.

[21] Appl. No.: 274,009

[22] Filed: Nov. 21, 1988

[51] Int. Cl.[5] ..... B61D 17/00; E06B 3/34; E05D 15/06

[52] U.S. Cl. ..... 105/378; 49/41; 160/196.1

[58] Field of Search ..... 105/378, 410, 339; 410/26; 49/41, 40; 160/196.1; 296/147

[56] References Cited

U.S. PATENT DOCUMENTS

| | | | |
|---|---|---|---|
| 3,995,563 | 12/1976 | Blunden | 105/378 |
| 4,077,330 | 3/1978 | Peisner et al. | 105/378 X |
| 4,084,516 | 4/1978 | Ravani et al. | 105/378 X |
| 4,437,410 | 3/1984 | Stoller et al. | 105/378 |
| 4,649,831 | 3/1987 | Burleson | 105/378 |
| 4,677,918 | 7/1987 | Baker et al. | 105/378 |

*Primary Examiner*—Robert J. Oberleitner
*Attorney, Agent, or Firm*—Barnes, Kisselle, Raisch, Choate, Whittemore & Hulbert

[57] ABSTRACT

A rail car having an end closure provided by a pair of sliding doors. Each side wall of the rail car has a main side wall portion which terminates adjacent one end of the rail car, and an upright ladder panel spaced from the main side wall portion to provide a vertical slot. The doors are guided for movement from a closed position across the end of the rail car to an open position in which the doors project through the slots. An upper ladder brace assembly mounted on the main side wall portion of each side wall is provided to support the upper end of the ladder panel. This upper ladder brace assembly has an elongated brace member which is rigidly connected to the upper ladder panel. The brace member is bowed outwardly to be entirely outside the path of the door so as not to interfere with the movement of the door to open position.

3 Claims, 4 Drawing Sheets

D1
29
42
36
27
D1
26
96
66
35
64
34
104
28
83
24
68
22
82
94
97
100
84
90
20
18
12
80
92
86
16
88
17

29
26
36
D1
35
34
96
83
28
94
82
27
5
97
100
5
84
92
86
80
88

97
99
88
82
D1

END DOOR FOR RAIL CAR

This invention relates generally to rail cars and refers more particularly to a rail car end closure construction.

BACKGROUND AND SUMMARY OF THE INVENTION

U.S. Pat. No. 3,995,563, which is owned by the assignee of this application, discloses an end closure which protects the rail car from illegal or unauthorized entry and which also protects the contents of the car from flying objects. The end closure comprises two sliding doors which can easily and quickly be moved between closed and open positions. When closed, the doors extend across the open end of the rail car. When open, the doors slide to a stored out-of-the-way position, permitting loading and unloading.

More specifically, each side wall of the rail car disclosed in that prior patent has a main portion which terminates a short distance from the end of the rail car, and also has an upright ladder panel beyond the end of the main side wall portion. The space between the main side wall portion and the upright ladder panel defines a vertical slot or gap through which one of the doors can move to open position. When the doors are open, the portions projecting through the slots are stored in open spaces on the outer sides of the side walls and do not materially limit or reduce the available loading space within the rail car. There is an upper ladder brace extending from the top of the main side wall portion to the top of the ladder panel, providing a cantilever support for the ladder panel. The upper ladder brace does not interfere with the movement of the door through the slot because it is positioned above the door.

Some time after the issuance of that patent, the assignee of this application designed and built and began marketing an end door construction with vertically extended doors. The door extensions reached above the level of the upper ladder braces. In order to avoid interference with the upper ladder braces, the door extensions were provided with cut-outs or notches to clear the upper ladder braces when the doors are moved to open position. This construction is also part of the prior art.

Also as part of the prior art is an end door construction with vertically extended doors in which there are no vertical slots in the rail car side walls. The side walls are bowed or bulged laterally outwardly of the door tracks so that the paths of the door are entirely inside the rail car. The side wall is not slotted, although there is a horizontal slot in the paneling connecting the top of each side wall with the roof of the rail car which clears the upper extended portion of the door when it is open.

In accordance with the general object of the present invention, involving the use of vertically extended doors, each door moves through a vertical slot in a side wall and is stored with a portion of the door outside the rail car. The ladder panel is cantilever supported by an upper ladder brace which is longer than the one used in the assignee's previous designs described above and is bowed laterally outwardly so as to be entirely outside the path of the door. Thus while the upper ladder brace still provides a connecting bridge between the main portion of the side wall and the ladder, it will not interfere with the movement of the door to open position.

Other objects and advantages of this invention will become apparent as the following description proceeds, especially when considered with reference to the accompanying drawings.

DETAILED DESCRIPTION

Figure 1:
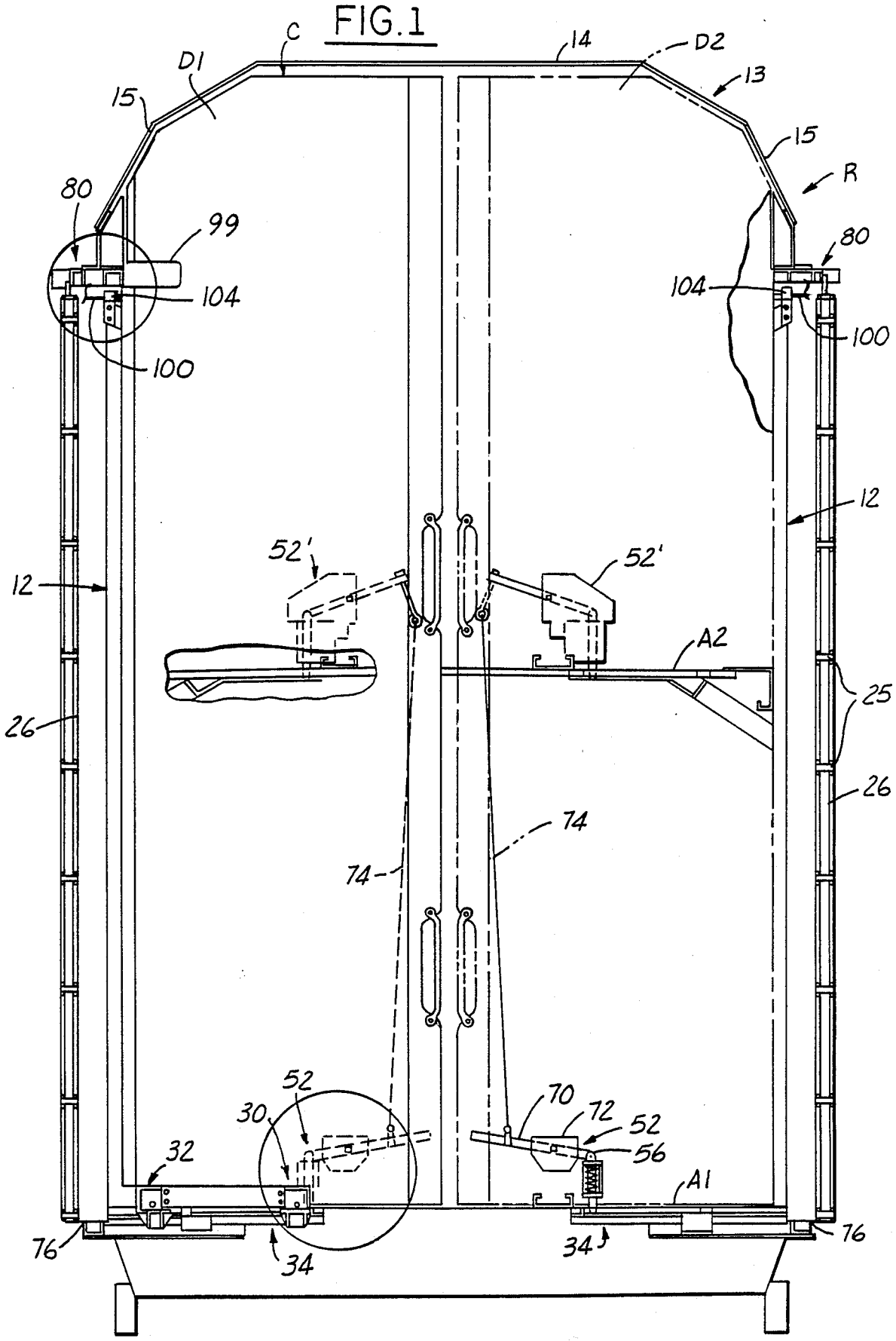
FIG. 1 is an end view of a rail car having an end closure constructed in accordance with the present invention, the end closure comprising a pair of doors one of which is partially broken away but the outline of which is shown in phantom lines.

Referring now more particularly to the drawings, the rail car is generally designated R and is shown as having the elongated longitudinally extending decks A1 and A2 which in this instance are especially adapted for the transport of road vehicles. Although the rail car R is bi-level, this invention is also applicable to a tri-level rail car.

The rail car has side walls 12 and is closed at the top by the roof structure 13 and is open ended. The roof structure has a central portion 14 above the tops of the side walls, and side portions 15 supported on and connected to the side walls. The main portion 16 of each side wall has paneling 17 supported by longitudinally aligned and spaced apart vertical posts 18 and, adjacent the end of the rail car, has paneling 20 between one of the posts 18 and the end-most post 22 which is set laterally inwardly slightly from the line of the posts 18. The main portion 16 of each side wall terminates in a vertical edge 24 a short distance from the end of the rail car.

Each side wall 12 also has an upright ladder panel portion 26 which has rungs 25 spaced apart vertically to enable a workman to climb to the deck A2 of the rail car. Each ladder panel portion 26 is spaced laterally outwardly and forwardly of the main side wall portion of the side wall, as will be apparent in FIG. 3, and cooperates with the vertical edge 24 of the main side wall portion 16 in defining a vertically extending slot or gap 28 which is open at the top. The slot or gap 28 in each side wall 12 provides an opening for the path of one of the doors of the end closure now to be described.

The end closure structure for one end of the rail car is generally designated C and comprises a pair of vertically upright doors D1 and D2, each adapted to extend across approximately one half of the end of the rail car so that together the two doors provide substantially a full end closure. The doors extend upwardly above the tops of the side walls so as to substantially fully close the end of the rail car from one side wall to the other and from the lower deck A1 up to the roof structure. It will also be understood that a similar end closure may be provided for the opposite end of the rail car.

Figures 3, 4, 5:
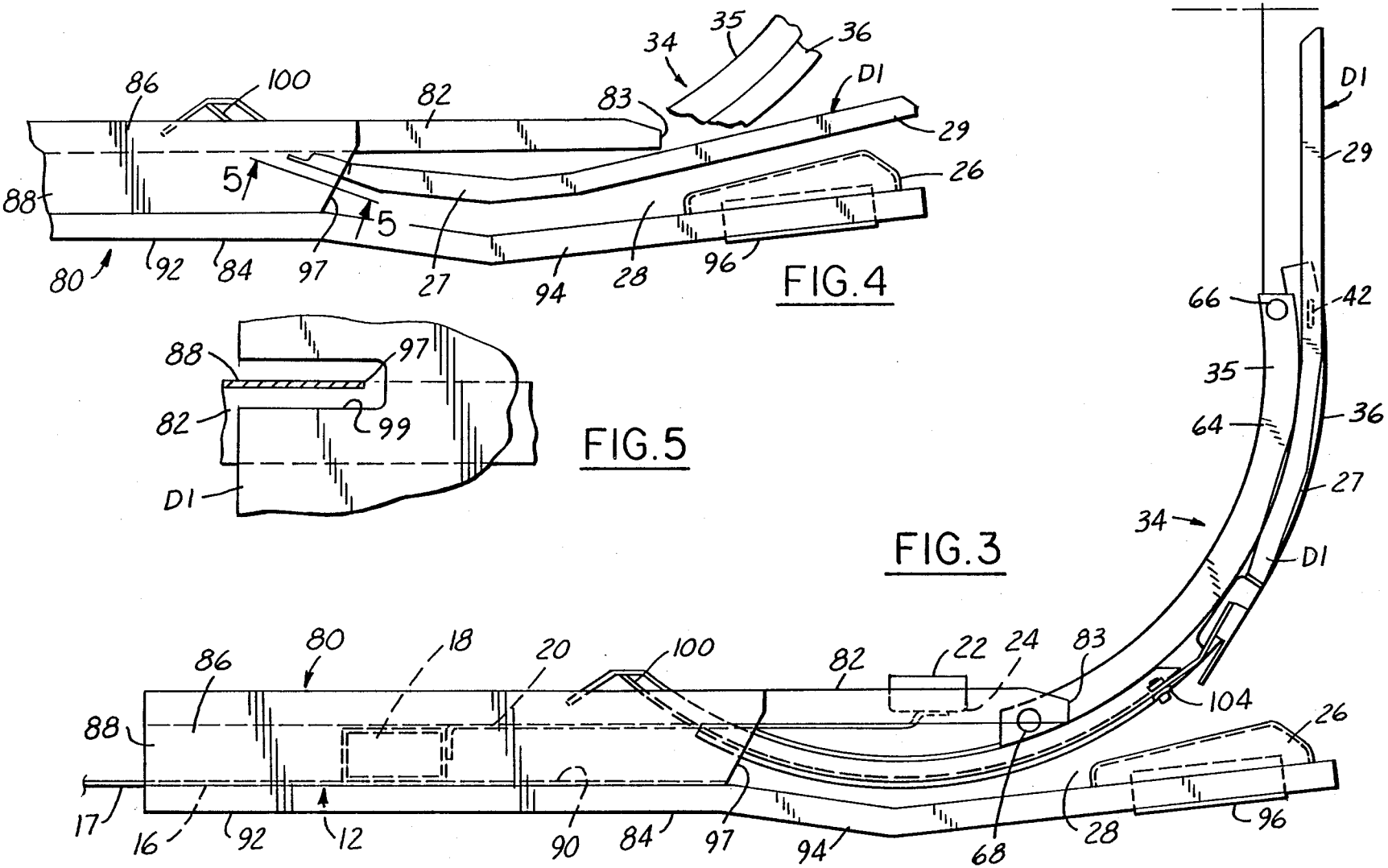
FIG. 3 is a view taken on the line 3—3 in FIG. 2 with the door in closed position.
FIG. 4 is a view similar to FIG. 3, but shows the door in open position.
FIG. 5 is a fragmentary sectional view taken along the line 5—5 in FIG. 4.
Figure 6:
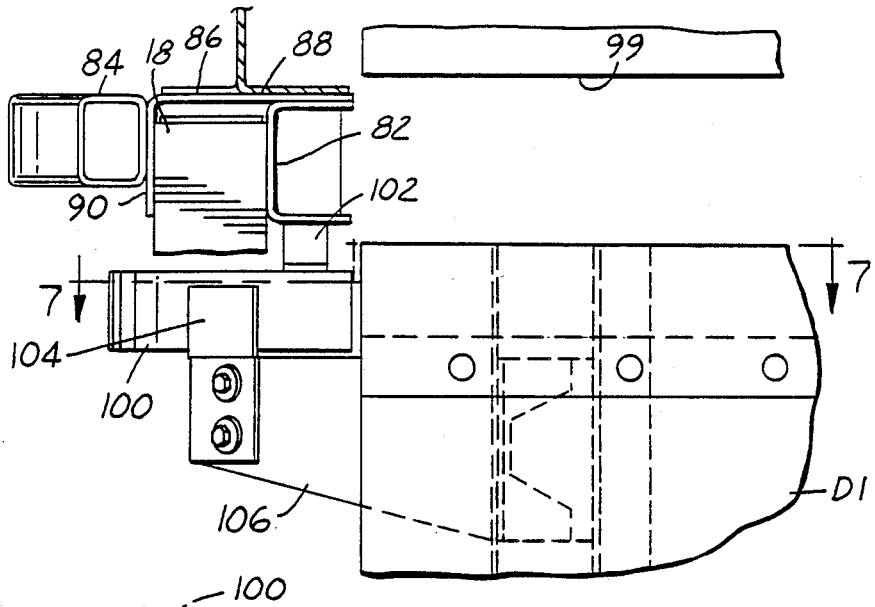
FIG. 6 is an enlarged view of the structure shown within the circle in the upper left portion of FIG. 1.
Figure 7:
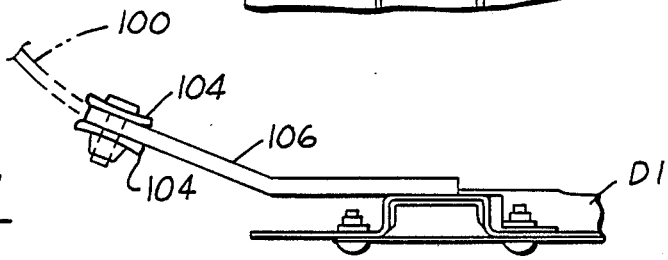
FIG. 7 is a sectional view taken on the line 7—7 in FIG. 6.
Figure 8:
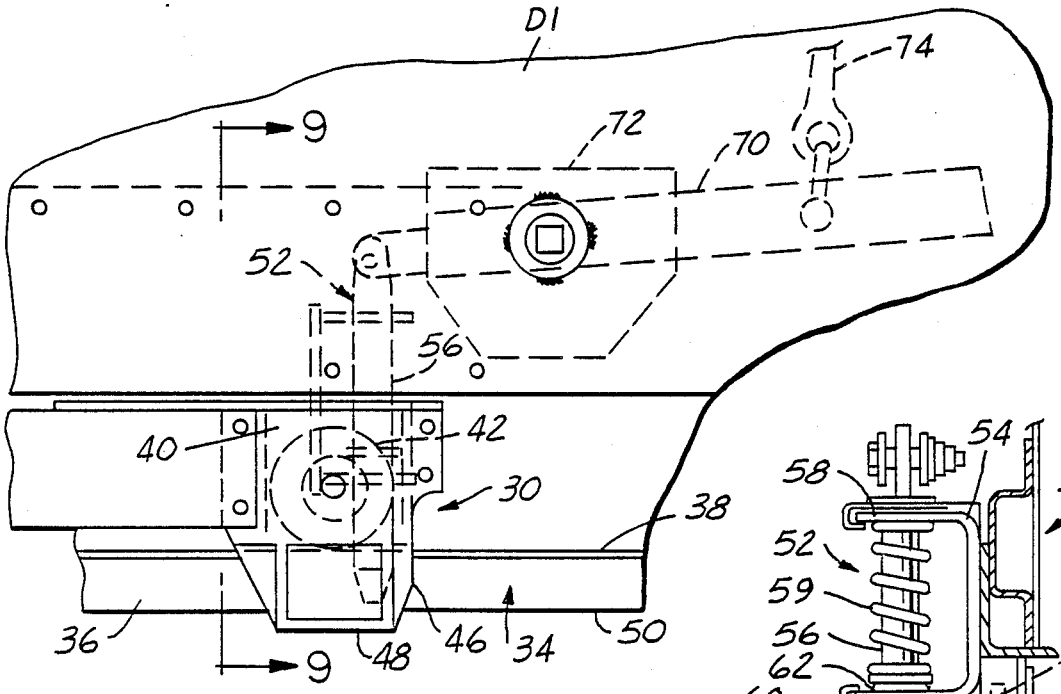
FIG. 8 is an enlarged view of the portion of the structure shown within the circle at the bottom of FIG. 1.
Figure 9:
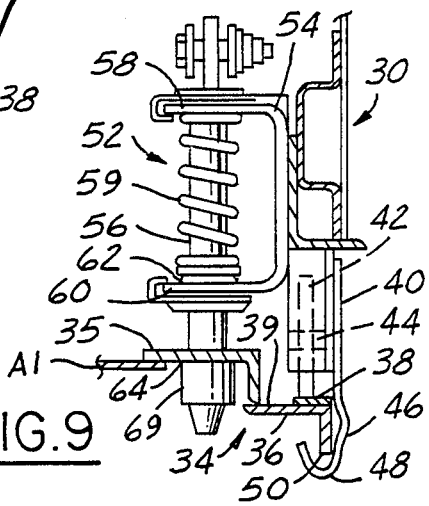
FIG. 9 is a sectional view taken on the line 9—9 in FIG. 8.

Each of the doors D1 and D2 is a vertical panel having the configuration in horizontal section as shown in FIG. 3. Thus each door has an arcuate laterally outer portion 27 and a straight laterally inner portion 29 which is tangent to the arc of the outer portion 27. It is supported for sliding movement from the closed position shown in FIG. 3 to the open position shown in FIG. 4. When the doors are closed, the straight portions 29 lie in a common plane at right angles to the longitudinal center line of the rail car.

The lower edge portion of each door is supported by roller assemblies 30 and 32 upon track structure 34 which may be of the same arcuate form as the portion 27 of the door. The arcuate track structure 34 is disposed in the corner of the rail car and extends through the gap or slot 28 in the side wall 12. The track structure 34 includes an arcuate angle member 35 secured to the deck A1 to which is connected a second arcuate angle member 36. The angle member 36 has a wear strip 38 on its horizontal flange 39. The roller assembly 30 in this instance comprises a roller housing 40 mounted on the door in which a roller 42 is journaled on a horizontal shaft 44 between the side walls of the housing and rolls on the wear strip 38. The roller runs on the wear strip of the track during movement of the door between closed and opened positions. One wall of the housing has a downward extension 46, the terminal portion 48 of which is bent under the vertical flange 50 of the track thereby preventing the door from becoming separated from the track. The other roller assembly 32 is of a similar construction.

A lock mechanism 52 is provided on the roller housing 40. Thus, the roller housing 40 has a channel-shaped bracket 54 secured thereto, with a vertical locking pin 56 slidable in the flanges 58, 60 of the channel. The pin 56 is urged downwardly by a coil spring 59 surrounding the pin and bearing against the bracket flange 58 and a collar 62 on the pin. Holes 66 and 68 in the horizontal flange 64 have bushings 69 to receive the pin 56 in the open and closed position of the door to releasably lock the door in either position.

The lock mechanism 52 also includes a lever 70 pivoted intermediate its ends to a plate 72 on the door, with one end of the lever pivotally connected to the upper end of pin 56. This lever is turned to raise the pin and release the door.

A similar lock mechanism 52' of substantially identical construction is mounted on each door at the level of deck A2. Both lock mechanisms 52 and 52' may be released by a cable 74 connecting the free ends of the levers 70.

Figure 2:
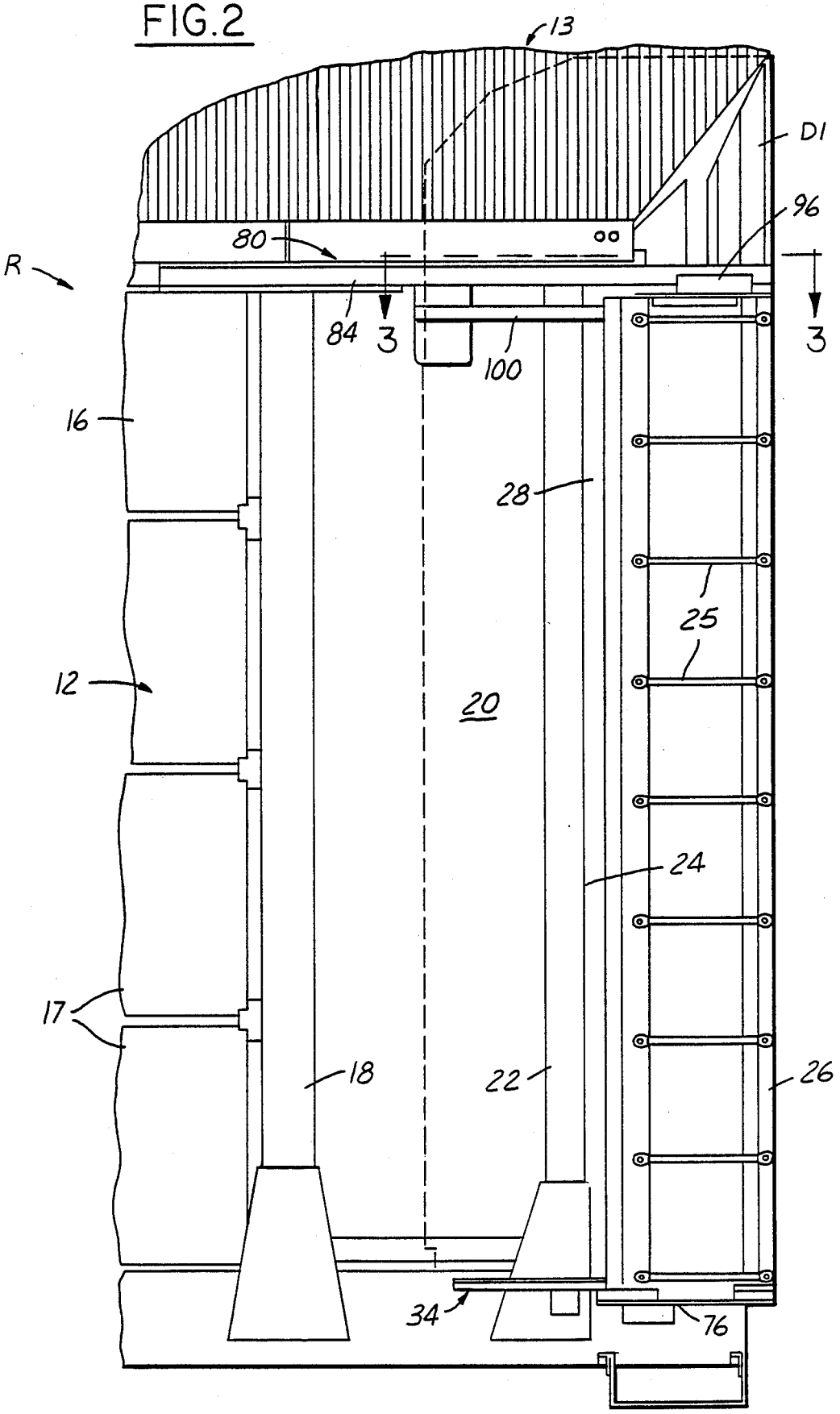
FIG. 2 is a fragmentary side elevational view of the end portion of the rail car shown in FIG. 1.

The lower end of the ladder panel 26 of each side wall 12 is rigidly secured to the deck A1 of the rail car where indicated at 76 in FIGS. 1 and 2. The upper end of each ladder panel 26 is supported by an upper ladder brace assembly 80.

Each upper ladder brace assembly 80 comprises an elongated horizontal support member 82 in the form of a channel extending along the top of a side wall and rigidly secured to the posts 18 and 22, terminating just beyond post 22. The end 83 of support member 82 is spaced from the ladder panel 26 to clear the door when the door moves to open position through slot 28. An elongated tubular brace member 84 is secured to the support member 82 by means of a plate 86 of relatively thin material. The plate 86 has a flat horizontal flange 88 rigidly secured to the top of the support member 82 and a flat vertical flange 90 rigidly secured to a straight portion 92 of the brace member 84. The straight portion 92 of the brace member is parallel to the support member 82 and set laterally outwardly therefrom. The brace member has an outwardly bowed portion 94 the end of which is rigidly connected to the upper end of the ladder panel 26 by means of brackets 96. The doors extend upwardly above the upper ladder brace assemblies. However, the outwardly bowed portion 94 is spaced laterally outwardly from side wall 12 far enough to be entirely outside the path of the door when the door is moved to open position through slot 28 and so will not interfere with the movement of the door. As seen in FIG. 4, when the door is open, the door occupies the space between the support member 82 and brace member 84 without contacting either and without contacting the side wall. However, the edge 97 of the plate 86 adjacent the end of the rail car is in the path of the outer edge of the door as the door moves to fully open position. Accordingly, the outer edge of the door has a notch 99 formed therein to clear the plate when the door is fully open. (See FIGS. 1 and 5).

The plate 86 could be of a dimension such that its edge 97 is far enough removed from the end of the rail car (towards the left in FIG. 4) that it will not interfere with the movement of the door to open position, requiring no notching of the door. However, in order to provide extra support for the brace member 84, even though requiring minimal notching of the door, the edge 97 of plate 86 may be as illustrated in FIG. 4. The horizontal dimension of the notch, if any, thus depends on the location of the edge 97 of plate 86. The vertical dimension of the notch depends on the thickness of plate 86 and may, for example, be on the order of about three inches.

The upper portions of the doors D1 and D2 are guided by tracks 100. The tracks 100 are mounted on the support members 82 by brackets 102 and are curved on the same arc as tracks 34. Each track is in the form of a vertical flange the opposite sides of which are slidably engaged by tabs 104 carried by a bracket 106 mounted on the outer edge portion of each of the doors.

When the doors are moved from closed to open position, they move through the vertical slots 28 in the side walls 12 and in their fully opened positions the portions of the doors projecting through the slots will be stored in open spaces on the outer sides of the side walls and do not materially limit or reduce the available space within the rail car for loading. On the other hand, the paths of the tracks are set close to the side walls to maintain the opened doors within the allowed rail car clearance space. The doors D1 and D2 may be of a rigid construction, or they may be flexible or articulated.

What is claimed:

1. A rail car comprising laterally spaced side walls, a roof structure having a central portion above the tops of said side walls and side portions connected to the tops of said side walls, each side wall having a main side wall portion terminating in a generally vertical edge adjacent one end of said rail car and also having adjacent said one end of said rail car an upright ladder panel portion spaced forwardly and laterally outwardly from said generally vertical edge of said main side wall portion to provide a vertical slot, an end closure for said one end of said rail car comprising a pair of upright doors, said doors extending upwardly above said main side wall portions and ladder panel portions of said side walls, means for guiding said doors for lateral movement along predetermined paths from a closed position across said one end of said rail car to an open position in which said doors project through said respective slots with at least a portion thereof disposed at the outer side of and close to said main side wall portions of said side walls, and an upper ladder brace assembly mounted on the main side wall portion of each side wall and including an elongated brace member rigidly connected to the upper end of said ladder panel portion, said elongated brace members being entirely outside said predetermined paths of said doors so as not to interfere with the movement of said doors to open position, each upper ladder brace assembly including a support member, each support member being mounted on one of said main side wall portions adjacent the top thereof, and a connecting portion rigidly connecting said elongated brace member to said support member.

2. A rail car comprising laterally spaced side walls, a roof structure having a central portion above the tops of said side walls and side portions connected to the tops of said side walls, each side wall having a main side wall portion terminating in a generally vertical edge adjacent one end of said rail car and also having adjacent said one end of said rail car an upright ladder panel portion spaced from said generally vertical edge of said main side wall portion to provide a vertical slot, an end closure for said one end of said rail car comprising a pair of upright doors, said doors extending upwardly above said side walls, means for guiding said doors for lateral movement from a closed position across said one end of said rail car to an open position in which said doors project through said respective slots with at least a portion thereof disposed at the outer side of and close to said main side wall portions of said side walls, and an upper ladder brace assembly mounted on the main side wall portion of each side wall and including an elongated brace member rigidly connected to the upper end of said ladder panel portion, said elongated brace members being entirely outside the paths of said doors so as not to interfere with the movement of said doors to open position, each upper ladder brace assembly including a support member, each support member being mounted on one of said main side wall portions, and a connecting portion joining said elongated brace member to said support member, said connecting portion comprising a generally horizontal flat plate, said flat plate of said upper ladder brace assemblies terminating in end edges adjacent said one end of said rail car disposed in the paths of said doors, said doors having notches to clear said plates.

3. A rail car comprising laterally spaced side walls, a roof structure having a central portion above the tops of said side walls and side portions connected to the tops of said side walls, each side wall having a main side wall portion terminating in a generally vertical edge adjacent one end of said rail car and also having adjacent said one end of said rail car an upright ladder panel portion spaced forwardly and laterally outwardly from said generally vertical edge of said main side wall portion to provide a vertical slot, an end closure for said one end of said rail car comprising a pair of upright doors, said doors extending upwardly above said main side wall portions and ladder panel portions of said side walls, means for guiding said doors for lateral movement along predetermined paths from a closed position across said one end of said rail car to an open position in which said doors project through said respective slots with at least a portion thereof disposed at the outer side of and close to said main side wall portions of said side walls, and an upper ladder brace assembly mounted on the main side wall portion of each side wall and including an elongated brace member rigidly connected to the upper end of said ladder panel portion, said elongated brace members being entirely outside said predetermined paths of said doors so as not to interfere with the movement of said doors to open position, each upper ladder brace assembly including an elongated generally horizontal support member, each support member extending along and being rigidly mounted on the top of one of said main side wall portions, said elongated brace member of each upper ladder brace assembly being spaced laterally outwardly from said support member, and a connecting member rigidly connecting said support member to said brace member.

* * * * *